US005607296A

United States Patent [19]

Wadekamper

[11] Patent Number: 5,607,296

[45] Date of Patent: Mar. 4, 1997

[54] METHOD FOR REPAIRING AN INTERCHANGEABLE SINTERING FURNACE

[75] Inventor: Donald C. Wadekamper, Pleasanton, Calif.

[73] Assignee: General Electric Company, Schenectady, N.Y.

[21] Appl. No.: 434,680

[22] Filed: May 4, 1995

[51] Int. Cl.[6] ..... F27D 1/16

[52] U.S. Cl. ..... 432/3

[58] Field of Search ..... 432/3

[56] References Cited

PUBLICATIONS

"Pre-Operational Testing of a Continuous $MO_2$ Sintering Furnace," D. C. Wadekamper, Presented at American Ceramic Society Conference, Oct. 31–Nov. 3, 1976.

"SAF, Secure Automated Fabrication," Wadekamper et al.; Jul. 1981.

*Primary Examiner*—Noah P. Kamen

*Attorney, Agent, or Firm*—Nixon & Vanderhye

[57] ABSTRACT

The refractory section of a sintering furnace for sintering mixed oxide nuclear fuel pellets is disposed between a pair of glove boxes. Extensions from the opposite ends in communication with the sintering channel project through glove ports in the glove boxes, facilitating movement of boats containing the pellets through the sintering channel. Flexible material connects between the opposite ends of the refractory section and the glove boxes to isolate the extensions, glove boxes and sintering channel from the surrounding environment. The refractory section may be replaced by disconnecting the extension from boat pushing apparatus, displacing the furnace away from one glove box, gathering the flexible material and sealing it at three longitudinal locations and severing the seal at the intermediate location whereby both the glove box and the sintering furnace are maintained isolated. The opposite end of the refractory section is similarly disconnected from the glove box whereby a new sintering furnace can be disposed and coupled to the glove boxes while maintaining the sintering channel and glove boxes isolated.

5 Claims, 6 Drawing Sheets

METHOD FOR REPAIRING AN INTERCHANGEABLE SINTERING FURNACE

TECHNICAL FIELD

The present invention relates to a sintering furnace and methods of using a sintering furnace and particularly relates to sintering furnaces designed for the production of mixed oxide (MOX) nuclear fuel pellets.

BACKGROUND

Mixed oxide nuclear fuel pellets are typically sintered in a reducing atmosphere in a sintering furnace with a maximum of 6% hydrogen for safety reasons. Negative pressure glove boxes are used to prevent the escape of plutonium into the worker environment. There has been recent renewed interest in the fabrication technology for mixed oxide nuclear fuel pellets and, hence, renewed interest in the sintering operation which comprises the critical processing step in the fabrication of such pellets. Sintering establishes both the physical and chemical properties of the nuclear fuel necessary for reactor irradiation. Because the sintering operation is the controlling or limiting process in the fabrication of such pellets, a failure in that operation results either in the reduction or termination of fuel production until repair or replacement of the sintering furnace can be accomplished.

Continuous sintering furnaces utilized during the fabrication of nuclear fuel pellets, particularly urania fuel, are large and massive. Practically, the large size of these furnaces precludes their use in a glove box arrangement required for MOX fuel pellet fabrication because of the difficulty associated with operation and maintenance. Glove boxes tend to be dimensionally small, although operating height is normally controlled by the size of the contained equipment. Because limited access techniques, e.g., glove ports, lead to operating and maintenance times which result in substantial downtimes in the pellet fabrication process, either the furnace capacity must be duplicated or easily maintainable furnace designs must be utilized. Duplication of furnaces to provide reliable production capacity is both very expensive and space-intensive. Small batch furnaces are readily maintainable but the production capacities are low and product uniformity is inconsistent.

Previously, MOX fuel pellets have been sintered in either small batch furnaces or reduced in size continuous furnaces designed for urania fabrication. The capacity of the batch furnaces is limited by the physical size associated with critically safe quantities of the nuclear material. Additionally, process variability has been observed between different sintering cycles and between different furnaces, which results in a final sintered product with variable uniformity. While large continuous sintering furnaces tend to eliminate the pellet uniformity problems, the difficulties associated with operating and maintenance cycles result in increased process downtime.

DISCLOSURE OF THE INVENTION

According to the present invention, there is provided an interchangeable, continuous sintering furnace which results in a more uniform product and reduced process downtime. Product uniformity is improved because each pellet experiences an identical sintering environment as every other pellet. Because of the critical nature of the sintering furnace in the fabrication process, process downtime is minimized in the present invention by affording interchangeable refractory sections of the sintering furnace between the glove boxes. Whereas repair of a failed sintering furnace normally required several weeks and, at times, months, to accomplish, the present invention enables the replacement of a failed furnace in a shortened period of time, e.g., a few days, while simultaneously maintaining a safe worker environment and isolation of the toxic materials.

Key to the present invention is the interchangeability of the refractory section of the sintering apparatus and its replacement with a new refractory section in a minimum of downtime. To accomplish this, when such replacement has been found desirable, the refractory section of the sintering furnace is disposed between a pair of glove boxes at its opposite ends. At the entrance end, an extension of the sintering channel of the refractory section extends through a glove port for connection with a pusher for pushing boats containing the MOX pellets to be sintered through the furnace. It will be appreciated that the boat pusher, fuel pellet feeder, and boat feeder are conventional in construction and are located within a first glove box at the entrance end of the sintering furnace. A flexible material, such as a plastic material, extends from about the glove port to an extension from the entrance channel of the refractory section of the sintering furnace. At the exit end of the refractory section, an extension from the exit channel of the refractory section passes through a glove port of a second glove box. At the exit end of the refractory section, a similar flexible material is coupled about the extension between the glove port and the exit end of the refractory section of the furnace.

In operation, the pellets are disposed in boats within the first glove box and disposed in a pusher line for passage through the sintering channel of the sintering furnace. The sintering furnace, of course, has windings for heating the furnace to the desired temperature and various controls are provided for pushing the boats with the pellets to be sintered through the sintering channel in a timed relation. At the exit end, the sintered pellets are removed from the boats and the boats are returned to the first glove box for reuse.

Should it become necessary to remove the sintering furnace and particularly the refractory section thereof from the glove box line, for example, for repair, the entrance extension is disconnected from the port of the pusher within the first glove box. The refractory section of the sintering furnace is then displaced away from the first glove box to a position where the end of the extension has been withdrawn through the glove port of the first glove box. The sintering channel and the open end of the extension in communication with the channel both lie in communication with the glove box when withdrawn, thereby maintaining isolation from the surrounding environment. By gathering the flexible material beyond the end of the extension and then sealing the gathered material, the entrance end of the refractory section of the sintering furnace can be disconnected from the glove box while maintaining its isolation from the environment. Three seals are formed at longitudinally spaced locations such that the material is severed along an intermediate seal of the three seals. In this manner, both the first glove box and the entrance end of the sintering channel are maintained isolated from the environment.

Similarly, at the opposite exit end, the refractory section of the sintering furnace can be displaced away from the second glove box and the material gathered beyond the end of the second extension and sealed. By similarly severing the material while maintaining the seals intact, the exit end of the sintering channel and the second glove box are maintained isolated from the environment. Thus, the refractory section of the sintering furnace can be removed from the glove box line and a new refractory section placed into service in that line while maintaining isolation of the glove boxes. This can be accomplished by connecting and sealing new flexible material between the extensions of the entrance and exit channels and the glove box ports followed by removal of the flexible materials from within the glove boxes to again uncover their ports for communication with the extensions of the new sintering furnace.

Additionally, the sintering furnace is provided with certain features which improve operability and eliminate maintenance or provide for modular repair. For example, pinned muffles are employed in the passage of the refractory section of the sintering furnace. The muffles define the channel through which the boats containing the pellets to be sintered are pushed. By employing two muffles joined end-to-end in the middle of the refractory section while leaving the opposite ends unrestrained, thermal expansion and contraction of the muffles can be accommodated. Further, the muffles are provided in a particular cross-sectional profile to prevent the boats from riding up one on top of another or causing boat jams in the sintering channel. The stacking-up of boats one on top of the other can crack the muffles and damage the windings, resulting in furnace failure. By correlating the cross-section of the muffles with that of the boats, a minimum clearance between the boat and muffle walls is provided which prevents boat ride-up and nuclear criticality problems. Moreover, the width of the muffles and the length-to-width ratio of the boats are correlated to prevent a crosswise jam in the furnace muffle during the pushing operation. Uniform sintering is promoted by providing a boat height such that no more than two layers of the nominal 0.5-inch pellets can be loaded randomly into the sintering boat. Thus, the pellets are randomly disposed in the boats but are no more than two pellet dimensions high.

Further, the boat pusher may comprise a soft shear pin such that a pushing force in excess of a predetermined force will cause the pin to shear and, hence, stop the pushing of the boats through the sintering channel. Redundant thermocouples are also provided at various axial locations along the sintering furnace. In this manner, failure of one thermocouple need not require furnace shutdown. Multiple-stage windings about the sintering channel provide variable temperature control and improved sintering flexibilities. Refractory furnace walls have also been improved with the elimination of silicon. This prevents refractory collapse from silicon depletion and ultimate furnace failure from a lack of muffle support. It also prevents gas line clogging from tramp impurities. Additionally, thin-wall cooling channels on the furnace allow for failure to the exterior and thereby prevents injection of water into the hot furnace, which would cause a safety hazard should the cooling channels fail.

The foregoing-described improved sintering furnace minimizes the occurrence of failure. Additionally, the ability to replace a failed refractory section in a sintering furnace enables reuse of the support system, i.e., glove boxes and ancillary equipment, at substantial cost savings. Because the interchangeable refractory sections tend to be smaller than a traditional sintering furnace, duplicate sintering furnaces may be required which enable continued production, albeit at a reduced rate should a furnace failure occur.

In a preferred embodiment according to the present invention, there is provided a method of producing mixed oxide fuel pellets comprising the steps of locating a refractory section of a sintering furnace having a sintering channel therethrough between first and second glove boxes with first and second extensions of the channel at opposite ends of the refractory section extending within the respective glove boxes, thereby isolating the sintering channel through the furnace and the extensions from the surrounding environment, disposing a first flexible sealing material between the first glove box and a first end of the refractory section and about the first channel extension, disposing a second flexible sealing material between the second glove box and a second end of the refractory section and about the second channel extension, displacing the refractory section away from the first glove box to withdraw the first extension from the first glove box while maintaining the channel and extensions thereof isolated from the surrounding environment, closing the first flexible sealing material onto itself beyond an end of the withdrawn first extension, sealing the closed material, severing the sealed material to disconnect the refractory section from the first glove box while maintaining the sintering channel and first glove box isolated from the surrounding environment, displacing the refractory section away from the second glove box to withdraw the second extension from the second glove box while maintaining the channel and extensions isolated from the surrounding environment, closing the second flexible material onto itself beyond an end of the withdrawn second extension, sealing the second closed material, severing the second sealed material to disconnect the refractory section from the second glove box while maintaining the sintering channel and second glove box isolated from the surrounding environment and removing the refractory section from between the glove boxes.

In a further preferred embodiment according to the present invention, there is provided a sintering furnace comprising an elongated enclosure containing refractory material and defining a passage through said enclosure between opposite ends thereof, a pair of elongated hollow muffles disposed in the passage in end-to-end relationship and defining a sintering channel between opposite ends of the enclosure, the muffles being connected to the furnace adjacent their adjoining ends with opposite ends thereof unrestrained relative to the furnace in a longitudinal direction to enable thermal expansion and contraction during operation of the sintering furnace.

In a still further preferred embodiment according to the present invention, there is provided a sintering furnace apparatus comprising an elongated enclosure containing refractory material and defining a passage through the enclosure between opposite ends thereof, at least one muffle in the passage defining a sintering channel between opposite ends of the enclosure, a pair of glove boxes at opposite ends of the enclosure and having glove ports, extensions of the sintering channel extending through the glove ports in communication with the glove boxes whereby materials to be sintered within the enclosure may pass from one glove box through the sintering channel into another of the glove boxes and flexible material extending between the opposite ends of the enclosure and connected to the glove boxes, the materials enveloping the extensions and maintaining the glove boxes and sintering channel isolated from the surrounding environment.

Accordingly, it is a primary object of the present invention to provide a novel and improved interchangeable refractory section of a sintering furnace, particularly for the production of mixed oxide nuclear fuel pellets.

BEST MODE FOR CARRYING OUT THE INVENTION

Figure 1:
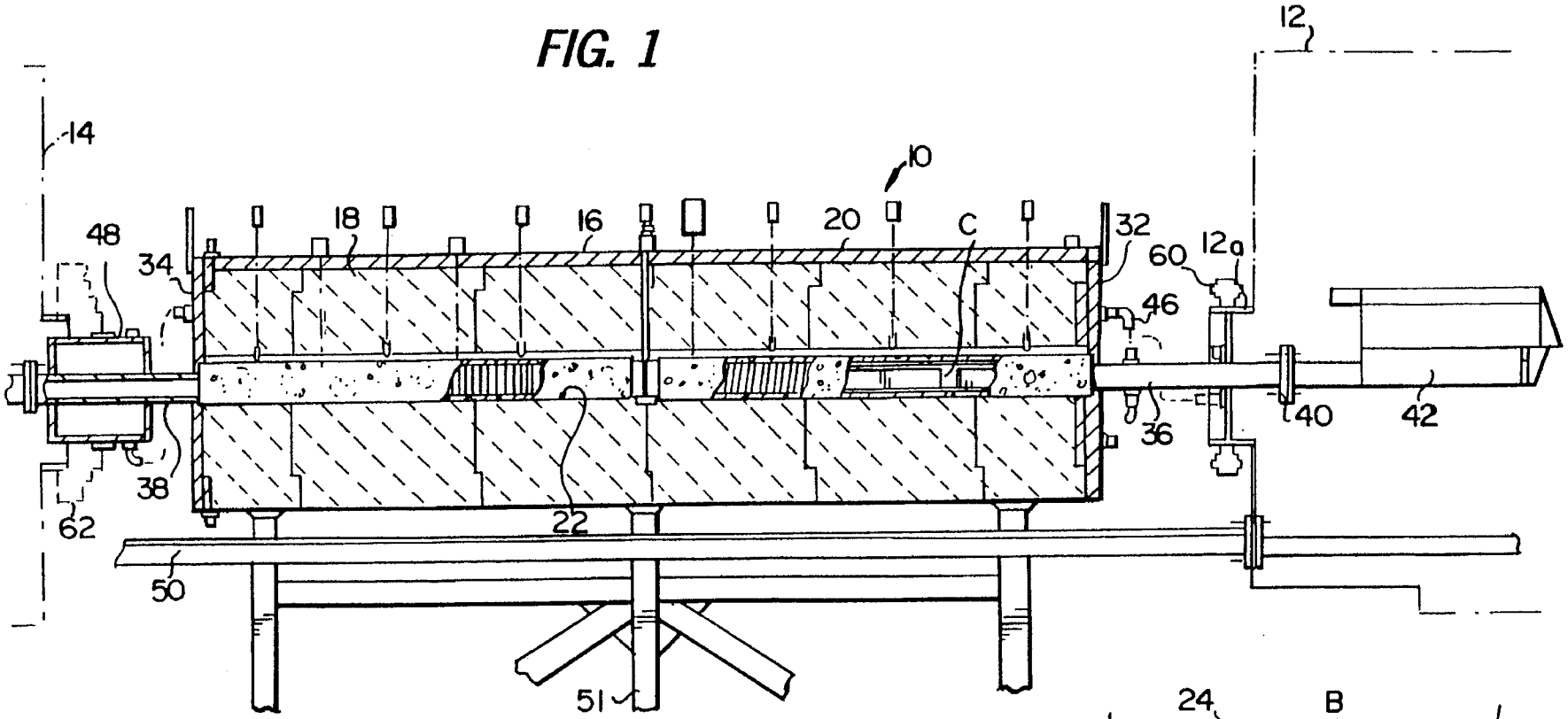
FIG. 1 is a longitudinal axial cross-sectional view through a sintering furnace disposed in a glove box line in accordance with the present invention.
Figure 5:
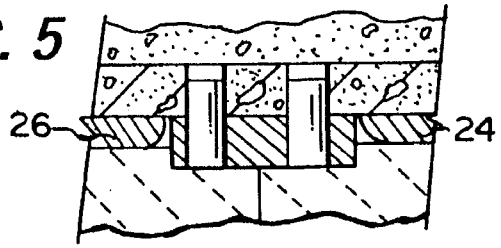
FIG. 5 is an enlarged fragmentary cross-sectional view illustrating a pinned connection of the muffles.

Referring now to the drawings, particularly to FIG. 1, there is illustrated an interchangeable sintering furnace system according to the present invention and comprising a sintering furnace, generally designated 10, disposed between first and second glove boxes 12 and 14, respectively. It will be appreciated that the glove boxes 12 and 14 are closed structures, preferably having a negative pressure, and have various glove ports for workers to facilitate operation of the sintering furnace, and particularly to feed the pellets and boats through the furnace. The sintering furnace 10 includes a refractory section 16, including refractory brick 18 disposed within a metal cylindrical casing 20 and arranged about a central passageway 22 which extends between entrance and exit ends of the refractory section. A pair of elongated muffles 24 and 26 are disposed within the passageway 22. As illustrated in FIG. 5, the inner adjoining ends of the muffles 24 and 26 are pinned to the refractory wall surfaces. Opposite ends of the muffles 24 and 26 remain unrestrained. Thus, the muffles may expand and contract in respective opposite directions in response to thermal gradients. The muffles also define a continuous sintering channel C (FIGS. 1 and 4) through the refractory section 16 of the sintering furnace. The refractory section 16 of furnace 10 is supported by supports 51 which can be supplied with wheels for facilitating its removal and replacement, as described hereafter.

Figure 2:
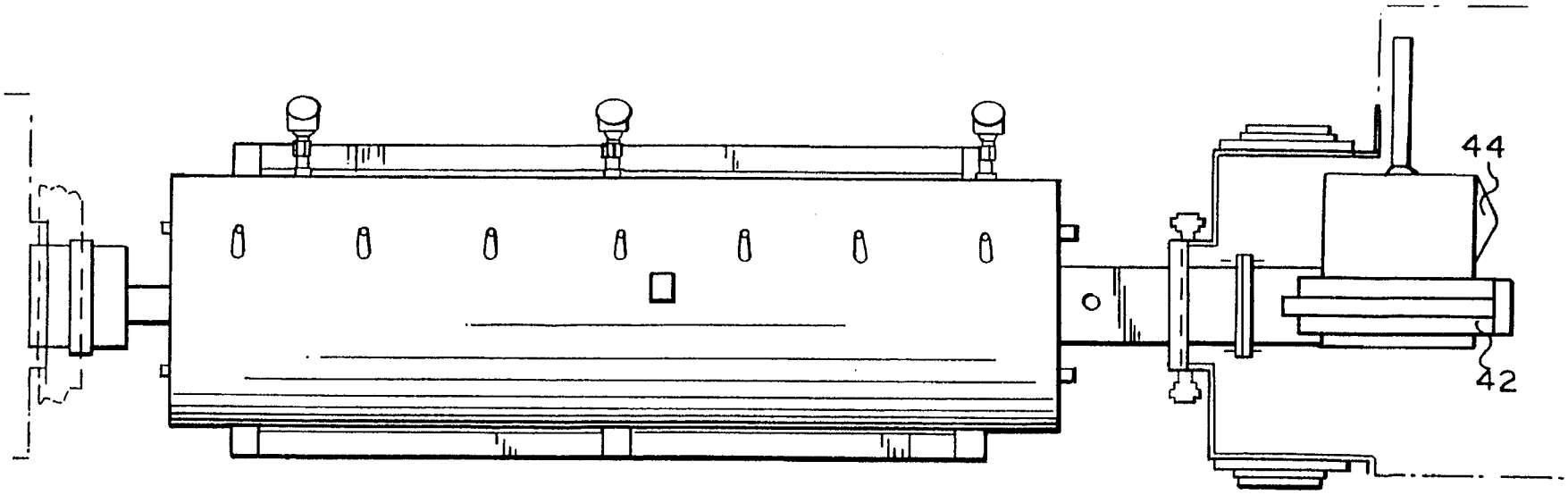
FIG. 2 is a top plan view thereof.
Figure 3:
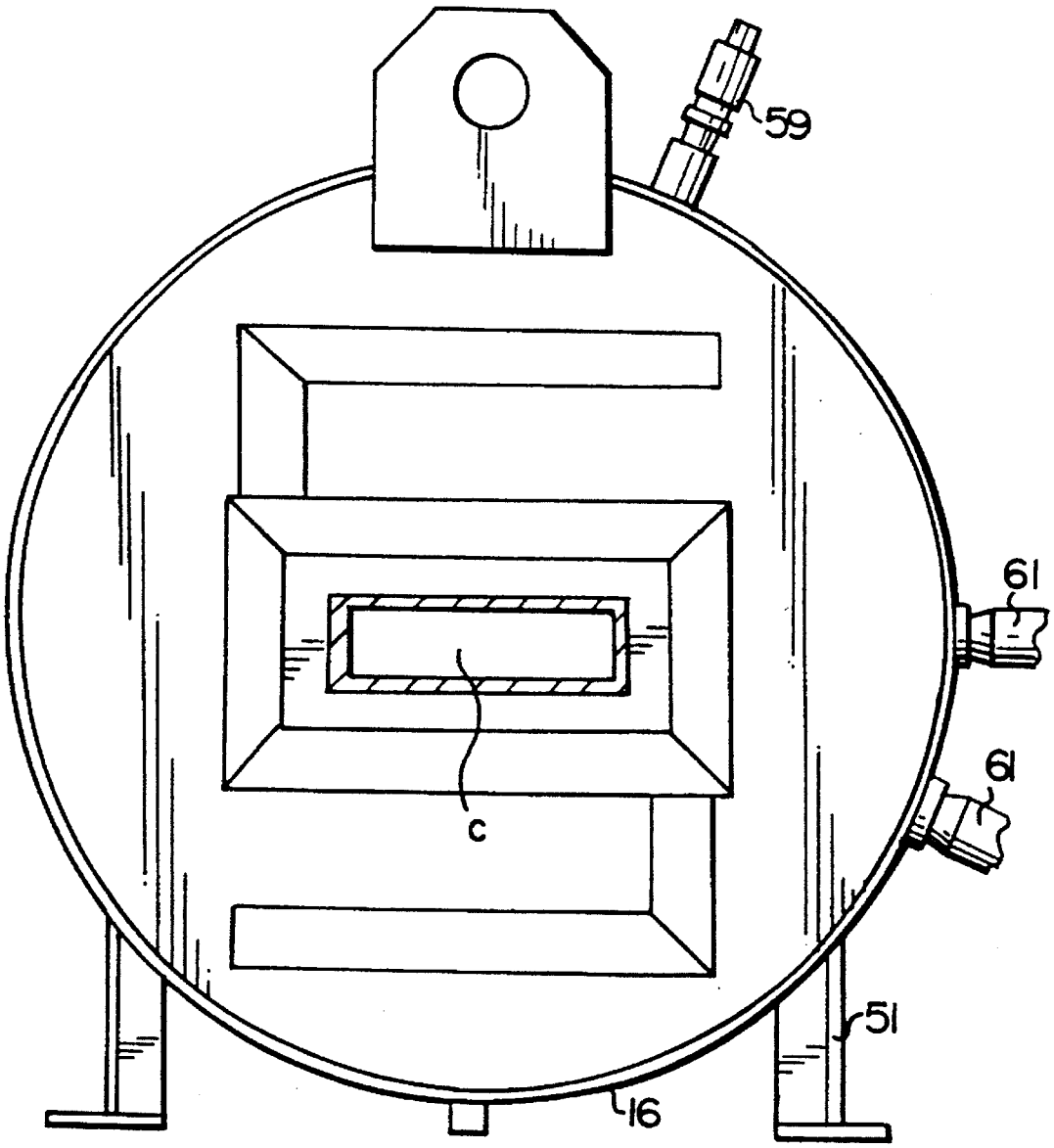
FIG. 3 is an enlarged entrance end elevational view of the refractory section of the sintering furnace.

Multiply controlled windings 28 are disposed about muffles 24 and 26 within the passageway 22 for heating the channel 30 defined by the muffles 24 and 26. The entrance and exit ends 32 and 34, respectively, of the refractory section are closed by snouts which mount entrance and exit extensions 36 and 38, respectively, of the muffles 24 and 26. At the entrance end, extension 36 is coupled by a bolted flange 40 to a conventional boat pusher 42 having a boat entrance 44 (FIG. 2) to one side of the pusher. The boat pusher is conventional in design and comprises a hydraulic cylinder which engages and pushes individual boats B (FIGS. 1 and 6) through the extensions and the sintering channel 24. It will be appreciated that the boat pusher and boat feeder, as well as a pellet feeder, not shown, are disposed within the glove box 12 and, hence, isolated from the surrounding environment. The extension 36 extends through a glove port 12*a*. For reasons discussed hereafter, a cooling water circuit 46 is provided between the entrance snout of the refractory section and the glove port.

Referring to FIG. 1, the exit end extension 38 extends through an annular section 48 having water inlet and outlet piping such that the interior of the section 48 carries cooling water. The extension 38 is coupled to a conventional device, not shown, whereby the boats may be emptied of sintered pellets and manually disposed on a conveyor 50 within the glove box 14 for return to the entrance glove box 12, where the boats are refilled with pellets and the sintering process continued. Whereas the entrance end of the extension 36 is secured to fixed structure within the glove box, the exit end of extension 38 is movable relative to the glove box 14.

Figure 6:
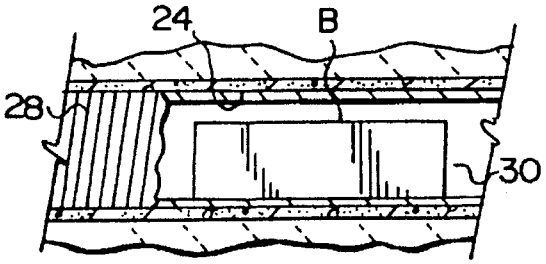
FIG. 6 is an enlarged cross-sectional view illustrating the passage of a boat through the sintering channel, as well as the windings.
Figure 4:
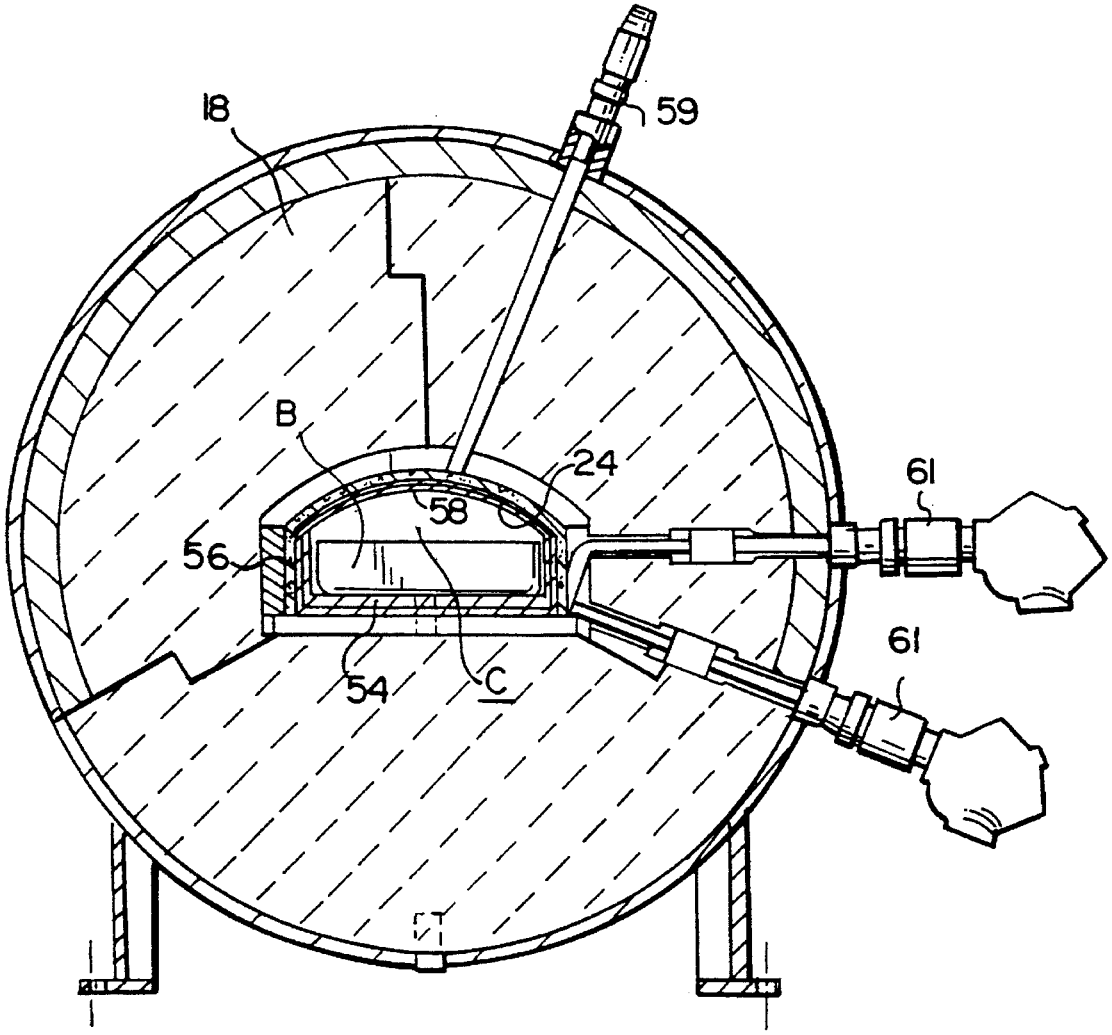
FIG. 4 is a cross-section of the sintering furnace.

Referring now to FIG. 4, it will be seen that the muffles 24 and 26 have a unique profile in cross-section. Each muffle has a linearly extending bottom wall 54 and upstanding side walls 56 with the side walls being interconnected by a concave upper wall or ceiling 58. Each boat B, as illustrated in FIGS. 4 and 6, has a length and width, as well as height, correlated to the profile of the muffles such that the boat B will not ride up on top of another boat within the channel or become jammed crosswise in the channel. Thus, the height dimension of the muffles is limited by the upper wall 58. The length-to-width ratio of the boats is about 2:1, with the length of the boat being greater than twice the width of the channel. In FIG. 4, thermocouples 59 and power connections 61 are also illustrated.

In accordance with the present invention, a flexible material 60 extends between glove port 12*a*' on the entrance of the sintering furnace and the glove box port 12*a*. Additionally, at the exit end of the sintering furnace, a similar flexible material 62 extends between the section 48 carried by extension 38 and the glove box port of the second glove box 14. The glove boxes 12 and 14 thus isolate the channel and extensions from the environment, while the flexible material provides isolation between the entrance and exit ends of the furnace with the glove box ports.

The operation of the sintering furnace will now be described. Through gloved ports, not shown, at the entrance glove port 12, an operator may load pellets to be sintered into boats B and locate the boats at the boat entrance. An air cylinder will then move the boat filled with pellets to be sintered laterally into an in-line position with a boat pusher and the extensions 36, 38 and channel C. The pellets are placed randomly into the boats from a feeder and an operator smoothes the pellets in the boat. The boats are displaced by the pusher one after the other through the sintering furnace, with each boat contacting a downstream boat and pushing it along the channel through the furnace. At the exit end and within the glove box, the boats are emptied manually by turning them over and displacing the sintered pellets into a feeder, not shown. An operator then removes the empty boat and places it on the boat return conveyor 50 for return to the entrance glove box.

Figure 7:
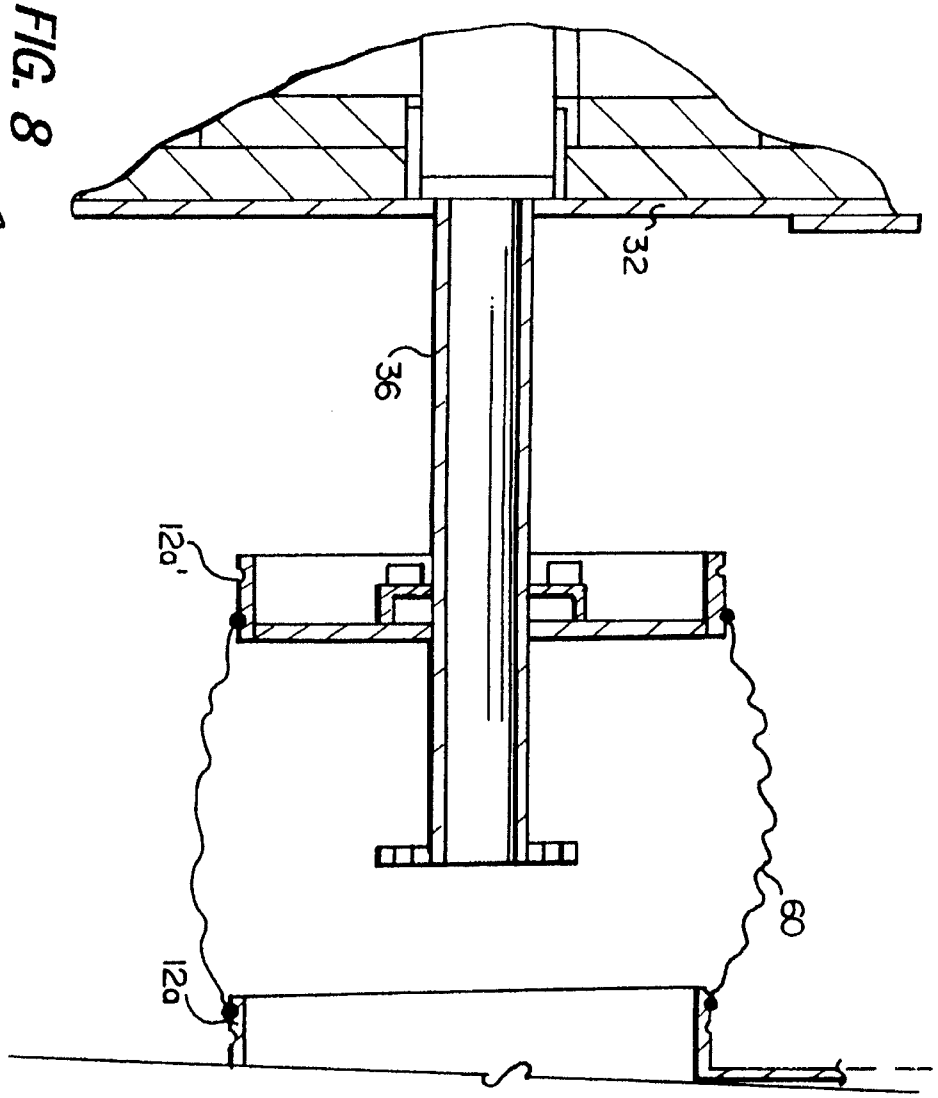
FIGS. 7 and 8 are enlarged fragmentary cross-sectional views of the entrance end of the refractory section of the sintering furnace illustrating the closing and sealing of the sintering channel during replacement of the refractory section.
Figure 8:
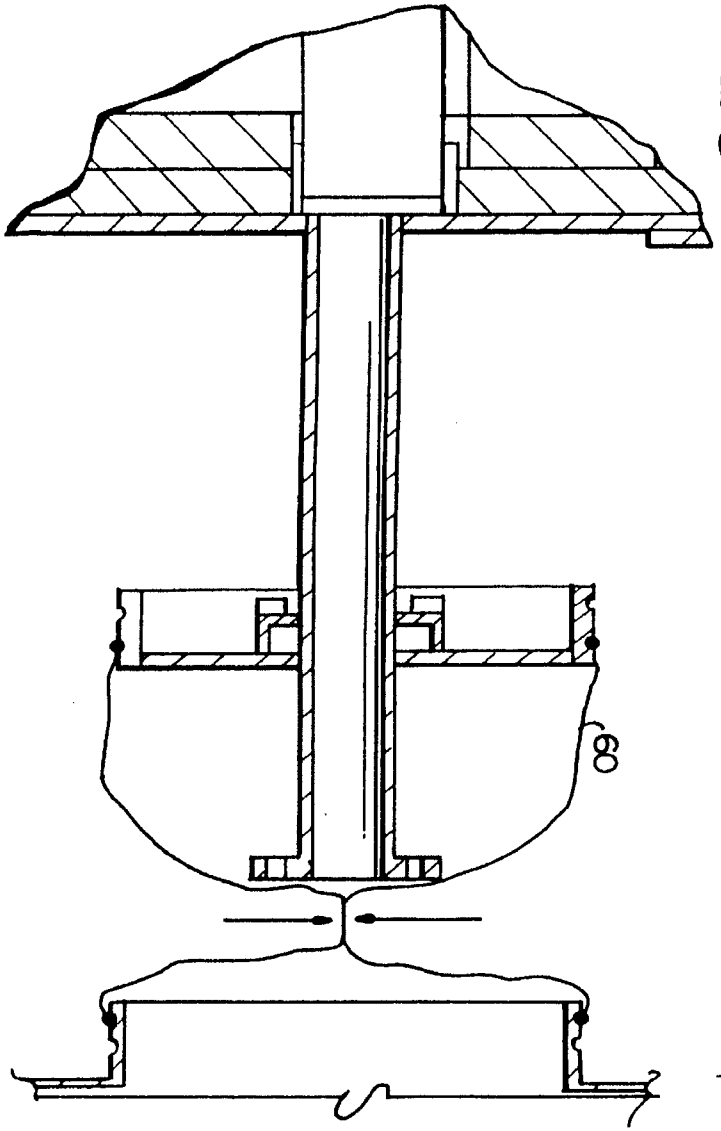
Figure 9A:
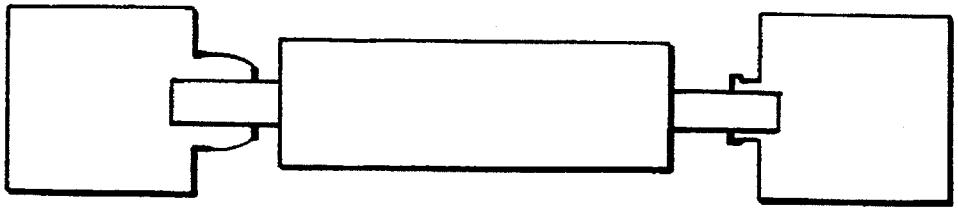
FIGS. 9*a*–9*d* are schematic diagrams illustrating the manner of replacement of the refractory section of the sintering furnace.
Figure 9B:
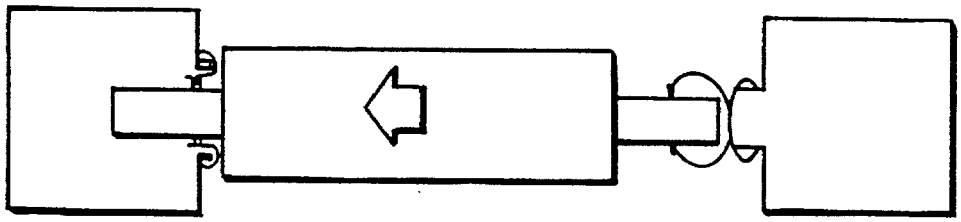
Figure 9C:
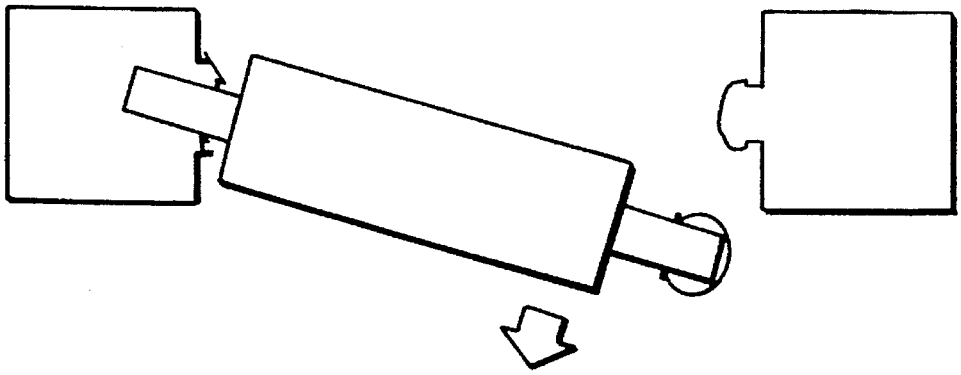
Figure 9D:
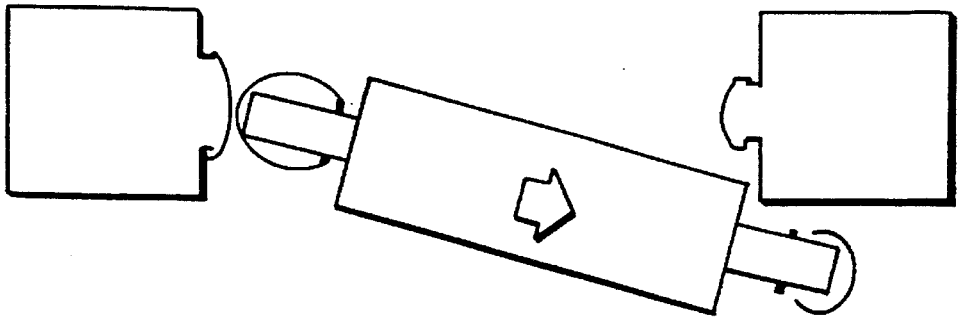

Referring now to FIGS. 7, 8 and 9, in the event of the need to repair the refractory section of the sintering furnace, the sintering furnace is first allowed to cool. The extension 36 is then disconnected from the pusher 42 at the flange 40. Next, the refractory section 16 is displaced away from glove box 12 toward glove box 14, locating the free end of extension 36 outside of the glove box port 12*a* which is split (12*a* and 12*a*') as illustrated in FIGS. 7 and 9*b*. The flexible material 60 accommodates displacement of the sintering furnace away from the glove box 12. Sufficient flexible material is provided so that, after such displacement, the material beyond the end of extension 36 can be gathered as illustrated in FIG. 8 and a seal formed. Preferably, a heat seal is provided along three longitudinally spaced areas of the gathered material. Thus, the intermediate seal can be cut, leaving the seals on opposite sides of the intermediate seal sealing the glove box port and end of extension 36, respectively. With glove part 12*a*' on the entrance end of the extension 36 and the glove box part 12*a* thus sealed, the refractory section can be displaced laterally as illustrated in FIG. 9*c* and then displaced away from glove box 14 such that the end of the exit extension 38 is removed from the glove box port. The flexible material 62 can then be similarly gathered, sealed in three places as previously described, and severed, thus sealing both the glove box port and the end of the extension 38. Consequently, the seals on the glove box ports and about the ends of the extensions maintain respective isolation between the glove boxes and the refractory section from the surrounding environment. The refractory section 16 can then be removed from the glove box line and replaced with another sintering furnace whereby production can be continued.

The replacement refractory section may be connected at its opposite ends with the glove ports by deploying new sleeves of flexible material between the glove ports and the refractory section extensions. The portion of the flexible materials sealing the glove ports can be removed from within the glove box. Thereafter, the extension 36 can be connected to the flange 40 leaving the opposite end free for thermal expansion and contracting movement.

Because the flexible materials are preferably formed of plastic and because high temperatures are typically obtained in the sintering furnace, it has been found necessary to cool the opposite ends of the sintering furnace to prevent melting of the flexible plastic material. Consequently, piping 46 is disposed to cool the interior of the flexible material 60 about the entrance end. Because of the higher temperatures at the exit end resulting from the emergence of the boats and sintered pellets, it has been found necessary to provide a cooling annulus formed by section 48 about the extension 38. Thus, the flexible material 62 between the exit end of the refractory section and the glove box 14 is isolated by the cooling water from the sintered pellets and boats as they exit the refractory section. This prevents melting of the plastic material 62 at the exit end of the furnace.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of repairing a furnace of mixed oxide fuel pellets comprising the steps of:

locating a refractory section of a sintering furnace having a sintering channel therethrough between first and second glove boxes with first and second extensions of the channel at opposite ends of the refractory section extending within the respective glove boxes, thereby isolating the sintering channel through the furnace and the extensions from the surrounding environment;

disposing a first flexible sealing material between the first glove box and a first end of the refractory section and about the first channel extension;

disposing a second flexible sealing material between the second glove box and a second end of the refractory section and about the second channel extension;

displacing the refractory section away from said first glove box to withdraw said first extension from said first glove box while maintaining said channel and extensions thereof isolated from the surrounding environment;

closing said first flexible sealing material onto itself beyond an end of the withdrawn first extension;

sealing the closed material;

severing the sealed material to disconnect the refractory section from the first glove box while maintaining the sintering channel and first glove box isolated from the surrounding environment;

displacing the refractory section away from said second glove box to withdraw said second extension from said second glove box while maintaining said channel and extensions isolated from the surrounding environment;

closing said second flexible material onto itself beyond an end of the withdrawn second extension;

sealing the second closed material;

severing the second sealed material to disconnect the refractory section from the second glove box while maintaining the sintering channel and second glove box isolated from the surrounding environment; and removing the refractory section from between the glove boxes.

2. A method according to claim 1 including coupling a second refractory section between said glove boxes after removal of the first-mentioned refractory section.

3. A method according to claim 1 including providing a boat pusher coupled to said first extension within said first glove box and, prior to displacing the sintering furnace from said first glove box, disconnecting said first extension from said boat pusher.

4. A method according to claim 1 including cooling at least one end of the sintering furnace about the extension at said one end to cool the flexible material thereabout.

5. A method according to claim 1 wherein the steps of sealing include forming at least three longitudinal separate seals along each of the first and second gathered sealing materials, and severing an intermediate gathered seal between the longitudinally separate seals.

* * * * *